US008733864B2

(12) United States Patent
Chen et al.

(10) Patent No.: US 8,733,864 B2
(45) Date of Patent: May 27, 2014

(54) TWO WAY DRAWER SLIDE

(75) Inventors: Kung-Cheng Chen, Taichung (TW); Lung-Chuan Huang, Taichung (TW)

(73) Assignee: E-Make Co., Ltd., Taichung (TW)

( * ) Notice: Subject to any disclaimer, the term of this patent is extended or adjusted under 35 U.S.C. 154(b) by 16 days.

(21) Appl. No.: 13/569,979

(22) Filed: Aug. 8, 2012

(65) Prior Publication Data

US 2014/0044382 A1 Feb. 13, 2014

(51) Int. Cl.
*A47B 95/00* (2006.01)
*A47B 88/00* (2006.01)

(52) U.S. Cl.
USPC ..... 312/333; 312/334.45; 312/334.46

(58) Field of Classification Search
USPC ..... 312/333, 334.44–334.47, 334.7, 334.8, 312/334.1, 286; 384/21
See application file for complete search history.

(56) References Cited

U.S. PATENT DOCUMENTS 4,178,049 A * 12/1979 Loo ..... 312/286
5,871,265 A * 2/1999 Stewart et al. ..... 312/334.8
6,457,790 B1 * 10/2002 Liang et al. ..... 312/334.46
6,682,158 B2 * 1/2004 Lai ..... 312/333
6,705,689 B2 * 3/2004 Chen et al. ..... 312/334.46
6,824,233 B2 * 11/2004 Chen et al. ..... 312/334.46
6,851,773 B2 * 2/2005 Chen et al. ..... 312/334.46
6,935,710 B2 * 8/2005 Chen et al. ..... 312/333
7,108,340 B2 * 9/2006 Lai ..... 312/334.46
8,511,765 B1 * 8/2013 Chen et al. ..... 312/333
2002/0140331 A1 * 10/2002 Chen et al. ..... 312/334.46
2004/0145285 A1 * 7/2004 Hwang et al. ..... 312/333
2005/0242692 A1 * 11/2005 Chiu ..... 312/334.47
2008/0111458 A1 * 5/2008 Hsu ..... 312/334.46
2008/0218047 A1 * 9/2008 Buczynski et al. ..... 312/334.12
2009/0310894 A1 * 12/2009 Yu et al. ..... 384/21

* cited by examiner

*Primary Examiner* — Janet M Wilkens
*Assistant Examiner* — Andrew Roersma

(57) ABSTRACT

A two way three section slide drawer slide assembly for permitting a drawer to be selectively pulled out from opposite open ends of a compartment is provided with an elongated outer section secured to the compartment; an elongated intermediate section disposed in the outer section; two elongated sliding members each slidably disposed either between upper edges of the outer section and the intermediate section or between lower edges of the outer section and the intermediate section; an elongated inner section including a two-end open flat track; an elongated bearing member disposed between the intermediate section and the inner section; two stop units releasably secured to the engaging members respectively; and two flexible limit members threadedly secured to the inner section. One limit member is disposed reverse to the other limit member.

1 Claim, 10 Drawing Sheets

TWO WAY DRAWER SLIDE

BACKGROUND OF THE INVENTION

1. Field of the Invention

The invention relates to drawer slides and more particularly to a drawer having two slide assemblies for allowing the drawer to selectively draw out (or pull back) from one of two opposite directions of a support body (e.g., desk, cabinet or the like).

2. Description of Related Art

A drawer is a box shaped container that fits into a piece of furniture in such a way that it can be drawn out horizontally to access its contents. However, typical drawers are designed to open or close from a front end of the drawer but not from either the front end or the rear end of the drawer.

In workshops, factories, service vehicles or the like two way or double pull drawers are necessary because opening or closing of the drawer from either the front end or the rear end thereof can facilitate work. Further, conventional drawers tend to malfunction. Furthermore, its components are complicated. In addition, its manufacturing cost is relatively high.

Thus, the need for providing a drawer having two slide assemblies for allowing the drawer to selectively draw out or pull back from one of two opposite directions of a support body (e.g., desk, cabinet, or the like) exists.

SUMMARY OF THE INVENTION

It is therefore one object of the invention to provide a two way travel three section slide drawer slide assembly for permitting a drawer to be selectively pulled out from opposite open ends of a compartment of a cabinet, comprising in combination an elongated outer section comprising a flat track threadedly secured to the compartment; an elongated intermediate section disposed in the outer section and comprising a flat track, two engaging members at both ends respectively, and two sets of two projecting stop members wherein one set of stop members is proximate to the engaging members at one end, and the other set of stop members is proximate to the engaging members at the other end; two elongated sliding members each slidably disposed either between upper edges of the outer section and the intermediate section or between lower edges of the outer section and the intermediate section wherein each sliding member is limited to travel in a distance between the stop members of the different sets; an elongated inner section comprising a two-end open flat track; an elongated bearing member disposed between the intermediate section and the inner section; two stop units releasably secured to the engaging members respectively; and two flexible limit members threadedly secured to the inner section wherein one limit member is disposed reverse to the other limit member; wherein one limit member is allowed to pass one stop unit when the drawer is pulled from one end of the compartment, and the other limit member is allowed to pass the other stop unit when the drawer is pulled from the other end of the compartment.

The above and other objects, features and advantages of the invention will become apparent from the following detailed description taken with the accompanying drawings.

DETAILED DESCRIPTION OF THE INVENTION

Figure 1:
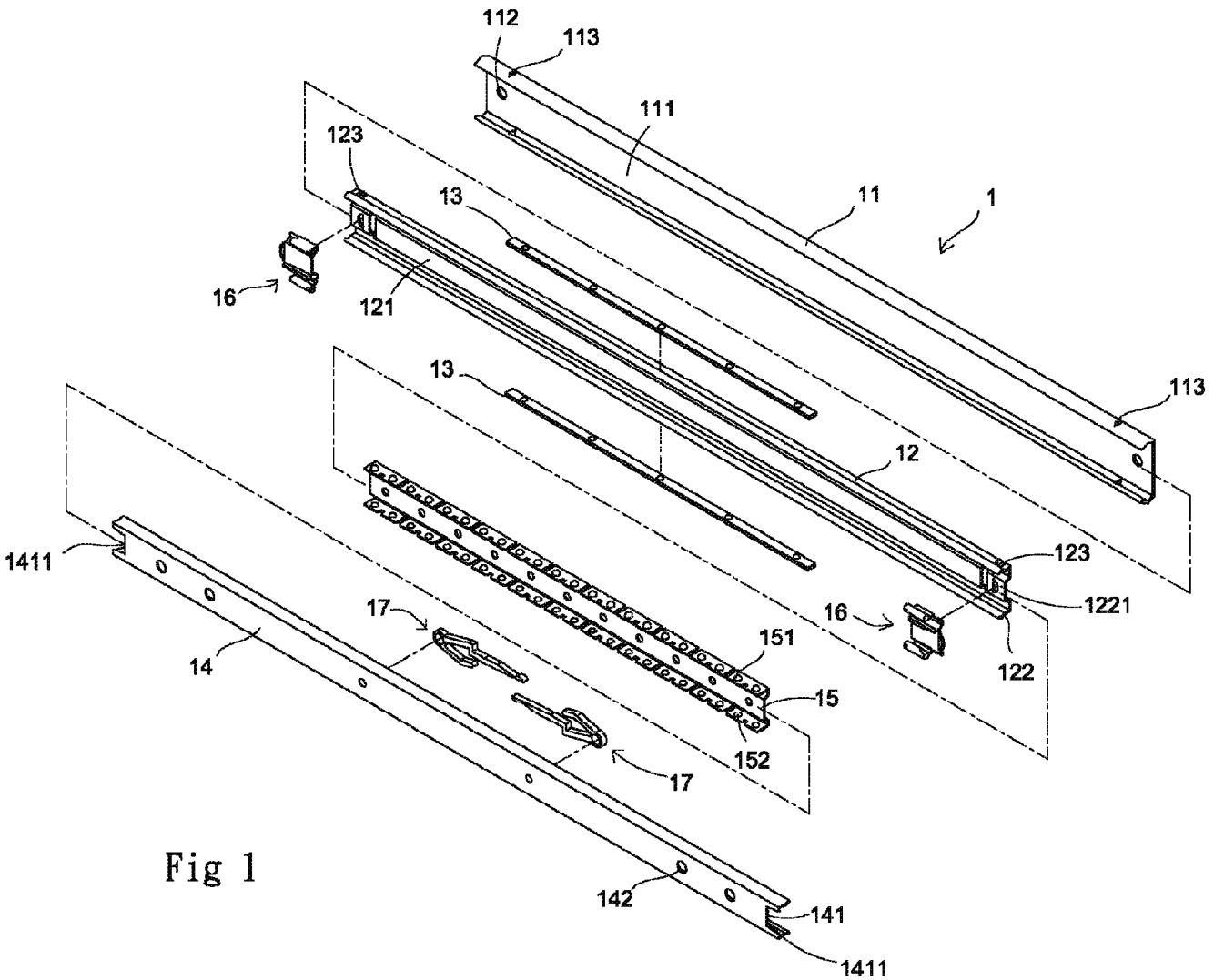
FIG. 1 is an exploded perspective view of a slide assembly for a drawer according to the invention.

Referring to FIGS. 1 to 10, a slide assembly 1 in accordance with the invention is shown. It is noted that identical assemblies 1 are mounted relative to opposite sides of a compartment 21 of a cabinet 2 and a drawer 22 so that a description of only one assembly 1 will suffice for present purposes.

The compartment 21 has a rear opening 211 and a front opening 212. On either side of the compartment 21 there is provided a positioning seat 213 including a curved well 214 on a top of the positioning seat 213. The drawer 22 has a space 221 defined therein and comprises, on either front end or rear end, a wall 222 and a handle 223 on a top edge of the wall 222. The drawer 22 further comprises two short, cylindrical pegs 224 formed on intermediate portions of both sides respectively. The peg 224 has about the same elevation as the well 214.

The slide assembly 1 comprises the following components as discussed in detail below. An elongated outer section 11 comprises a flat track 111, two threaded holes 112 proximate to both ends respectively, and two sets of two projecting stop elements 113 proximate the threaded holes 112 respectively, the two projecting stop elements 113 of either set being opposite and formed on one of two lengthwise curved edges of the track 111.

An elongated intermediate section 12 comprises a flat track 121, two engaging members 122 at both ends respectively, each engaging member 122 including a recess 1211, and two sets of two projecting stop members 123 proximate the engaging members 122 respectively, the two projecting stop members 123 of either set being opposite and formed on one of two lengthwise curved edges of the track 121.

Two elongated sliding members 13 are provided in which one sliding member 13 is retained between upper edges of the outer section 11 and the intermediate section 12 and the other sliding member 13 is retained between lower edges of the outer section 11 and the intermediate section 12. The provision of the sliding members 13 can reduce the friction of the outer section 11 and the intermediate section 12 when in motion as detailed later. Each sliding member 13 is limited to travel in a distance between the stop elements 113 of the same edge (i.e., between the stop members 123 of the same edge).

An elongated inner section 14 comprises a flat track 141 having two open ends 1411 and a plurality of threaded holes 142 between open ends 1411. The track 141 has two about 90-degree bent edges. An elongated bearing member 15 comprises a plurality of first balls 151 on an upper bent edge and a plurality of second balls 152 on a lower bent edge.

Figure 2:
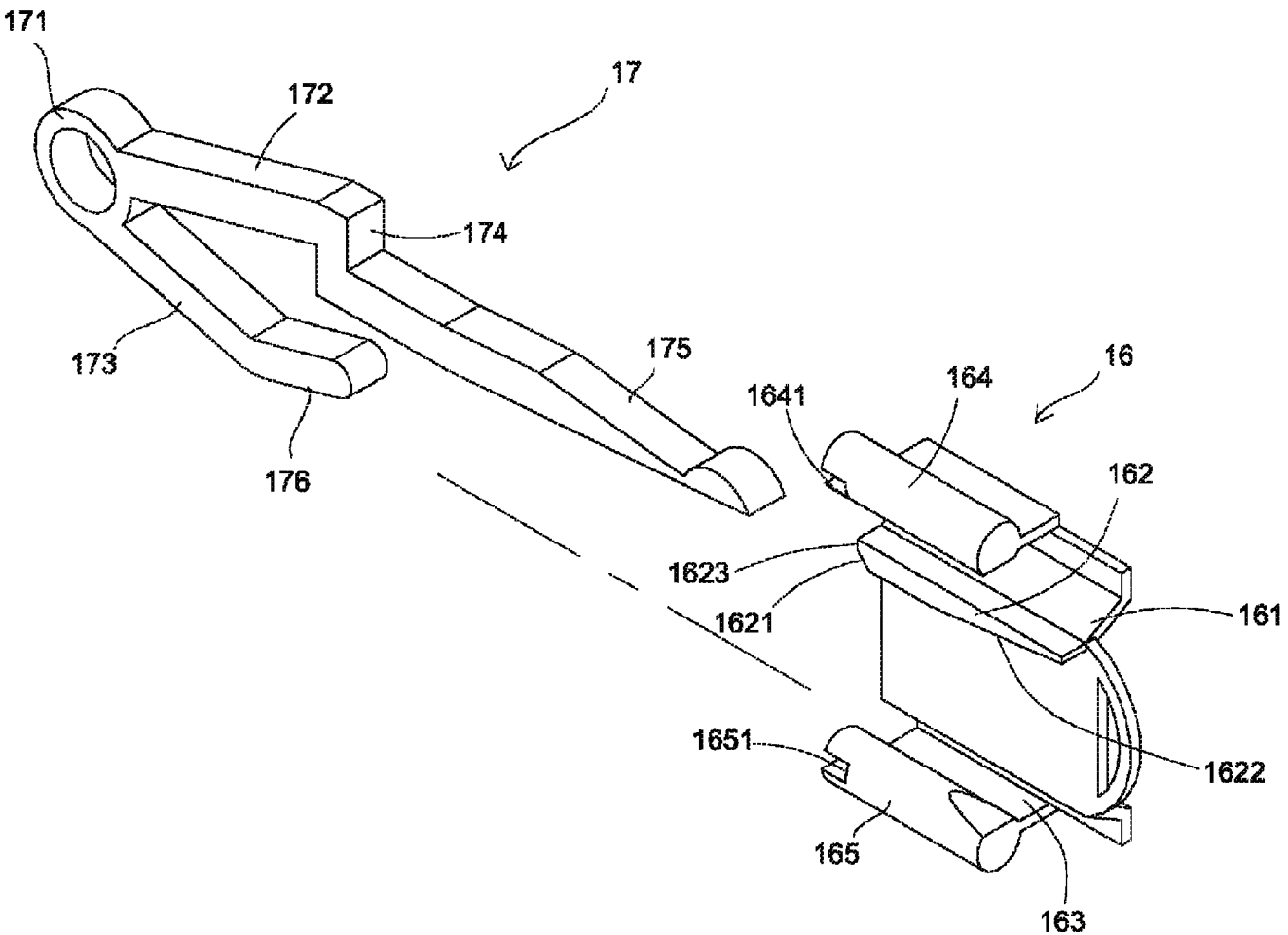
FIG. 2 is a perspective view of the limit member and the stop unit.
Figure 3:
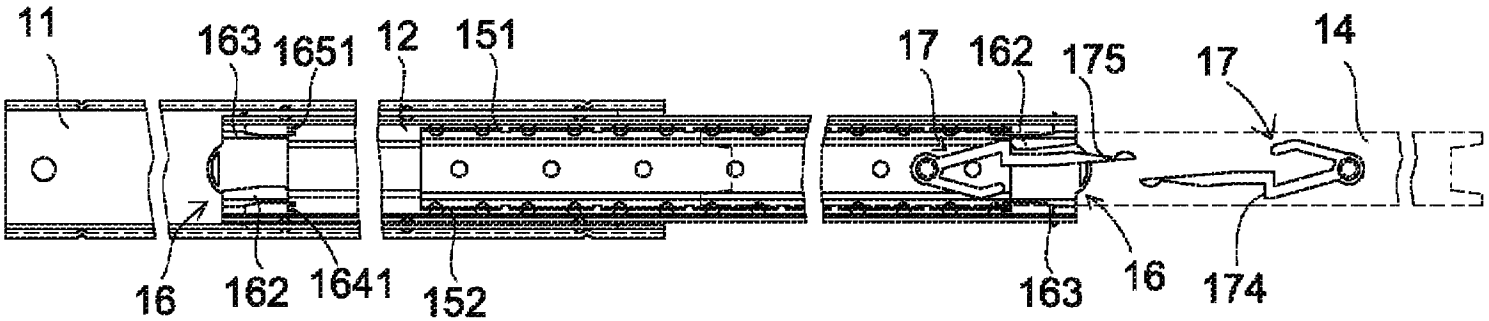
FIG. 3 is a side elevation in part section of the assembled slide assembly.
Figure 4:
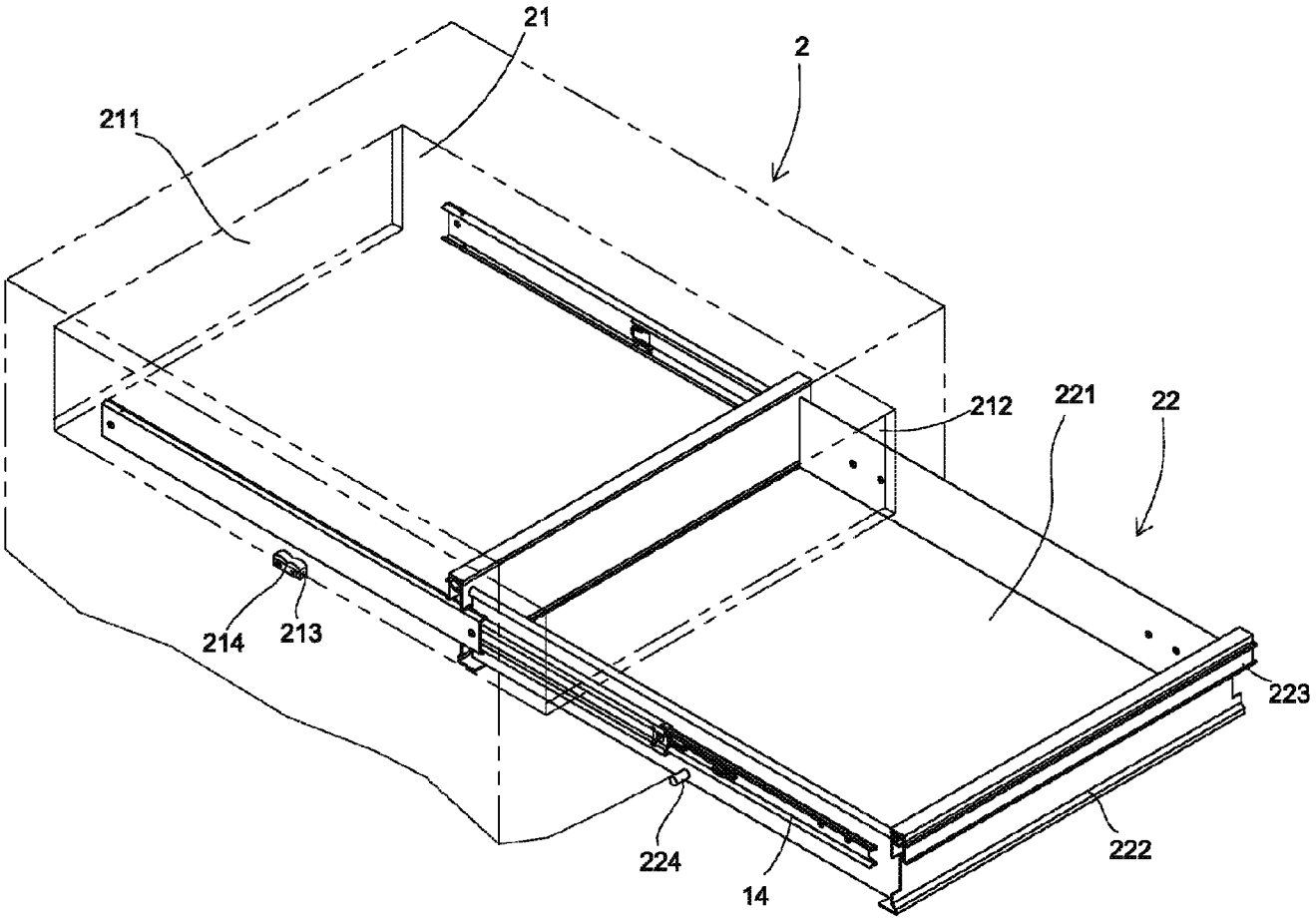
FIG. 4 is a perspective view of a cabinet and a drawer thereof being open to its maximum extent.
Figure 5:
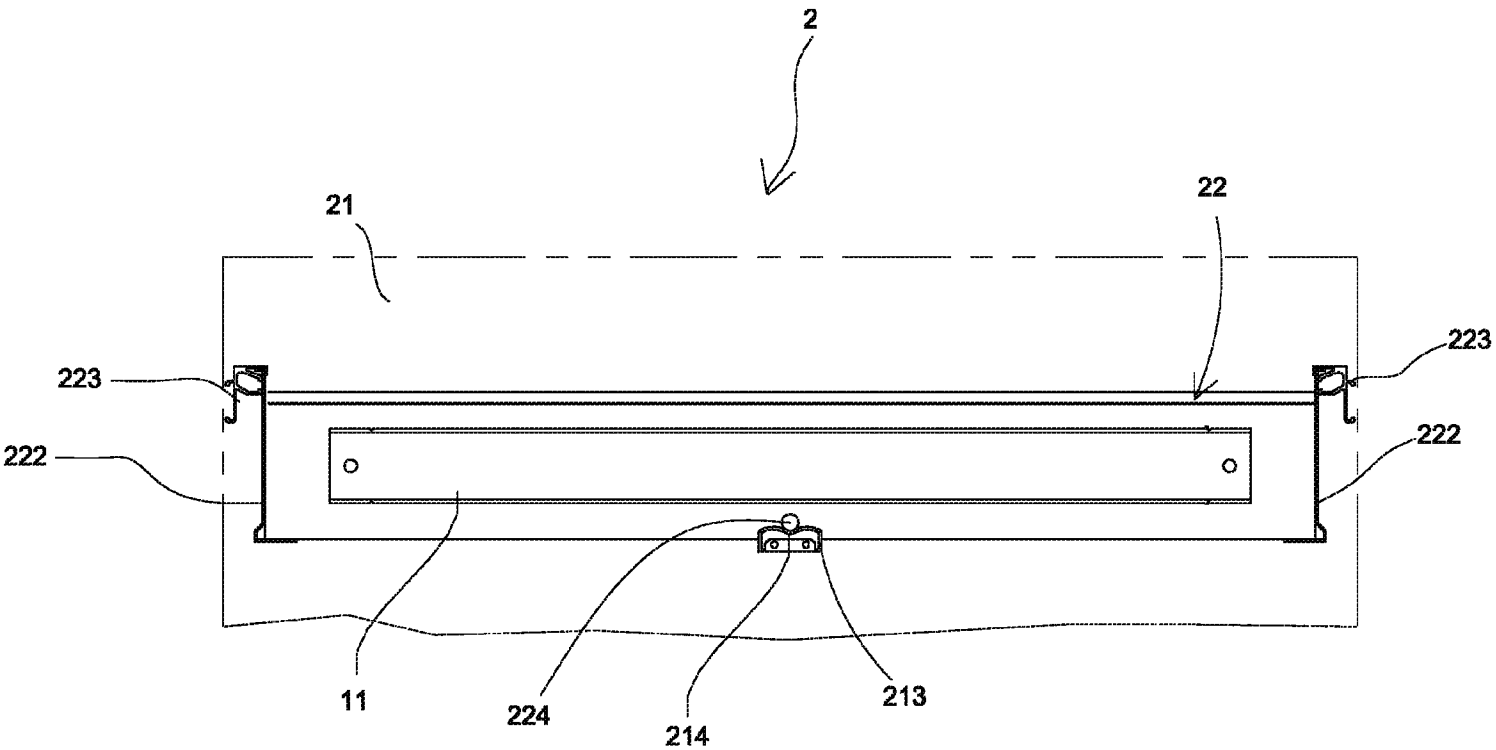
FIG. 5 is a side elevation of the cabinet with the drawer being retracted in a closed position.

As shown in FIG. 2 specifically, two stop units 16 each comprise two bent projections 161 on upper and lower edges respectively; a flange 162 extending from the upper edge but opposite to the adjacent projection 161, the flange 162 including a vertical surface 1623 at one end, an elongated, first inclined surface 1622 extending from the other end toward one end, and a short, second inclined surface 1621 joining to the vertical surface 1623 and the first inclined surface 1622; two horizontal sliding surfaces 163 each extending from one edge of the adjacent projection 161; a first rib member 164 extending from the upper sliding surface 163 and spaced from the flange 162 from above, the first rib member 164 including a cavity 1641 at one end; and a second rib member 165 extending from the lower sliding surface 163, the second rib member 165 including a cavity 1651 at one end. The cavities 1641 are adapted to catch both ends of the upper edge of the bearing member 15 and the cavities 1651 are adapted to catch both ends of the lower edge of the bearing member 15 respectively so that the bearing member 15 can be retained.

Two flexible limit members 17 each comprise a holed member 171; two arms 172, 173 extending from the holed member 171 in which one arm 172 is at an acute angle with respect to the other arm 173; a vertical segment 174 extending downward from one arm 172; an elongated latch 175 extending from the vertical segment 174; and an inclined segment 176 extending from the other arm 173.

The outer section 11 is secured to the side of the compartment 21 above positioning seat 213 by driving threaded fasteners through the threaded holes 112 into the side of the compartment 21. The inner section 14 is secured to the side of the drawer 22 by driving threaded fasteners through the threaded holes 142 into the side of the drawer 22. Thus, the limit members 17 are spaced and face each other. Further, one limit member 17 is disposed reverse to the other limit member 17 (see FIG. 3). The holed members 171 of the limit member 17 are threadedly secured to the flat track 141 of the inner section 14.

The intermediate section 12 is disposed in the outer section 11. One sliding member 13 is retained by and between upper edges of the outer section 11 and the intermediate section 12 and the other sliding member 13 is retained by and between lower edges of the outer section 11 and the intermediate section 12 so as to reduce friction between the outer section 11 and the intermediate section 12. The bearing member 15 is disposed in a space defined by both the intermediate section 12 and the inner section 14. The projection 161 is retained in the recess 1221 in friction fit. The peg 224 is rested upon the well 214 when the drawer 22 is retracted into a closed position (see FIG. 5).

Figure 6:
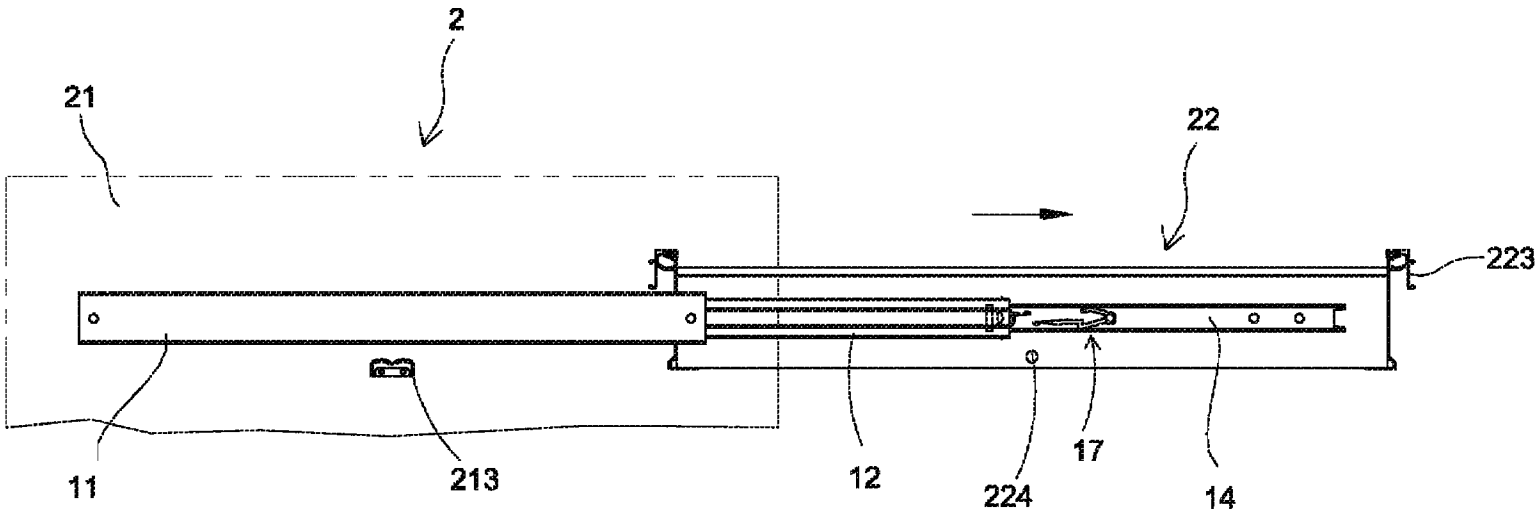
FIG. 6 is a view similar to FIG. 5 showing the drawer being fully open.
Figure 7:
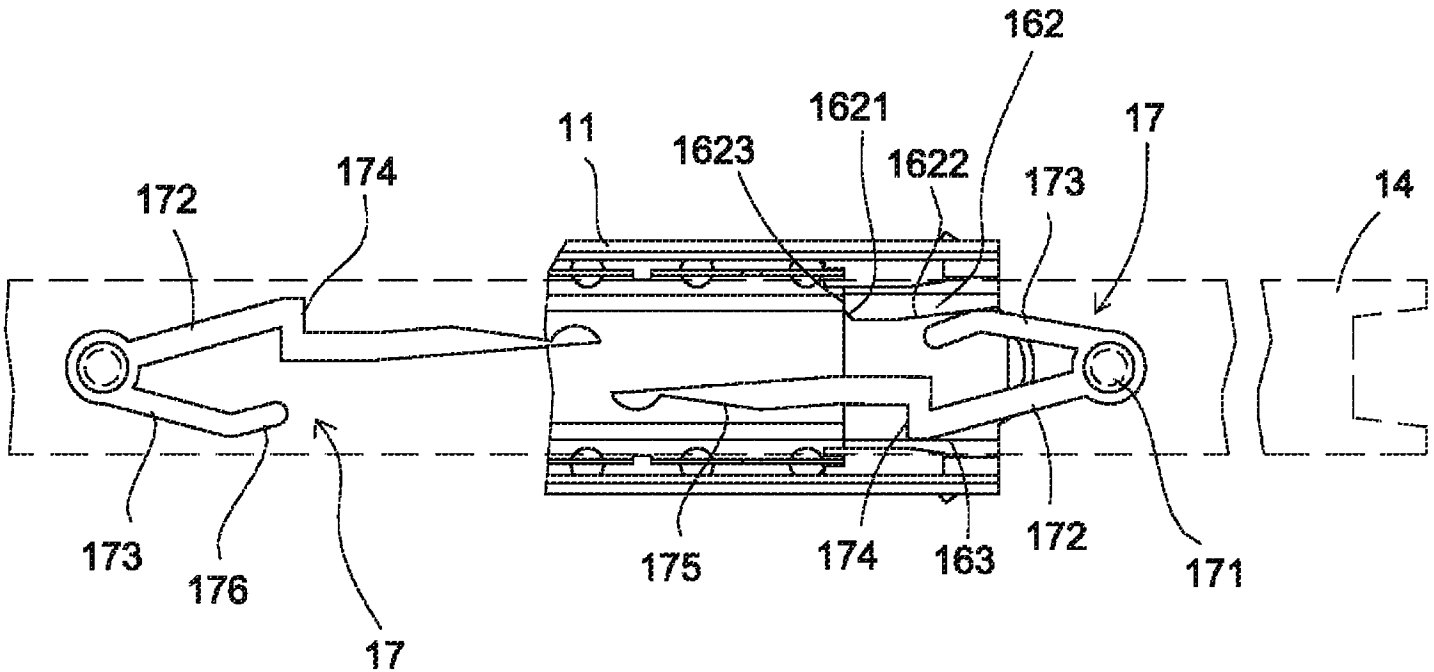
FIG. 7 is a side elevation in part section of a portion of the slide assembly showing the other limit member freely passing the stop unit when the drawer is being opened from the front end of the cabinet.
Figure 8:
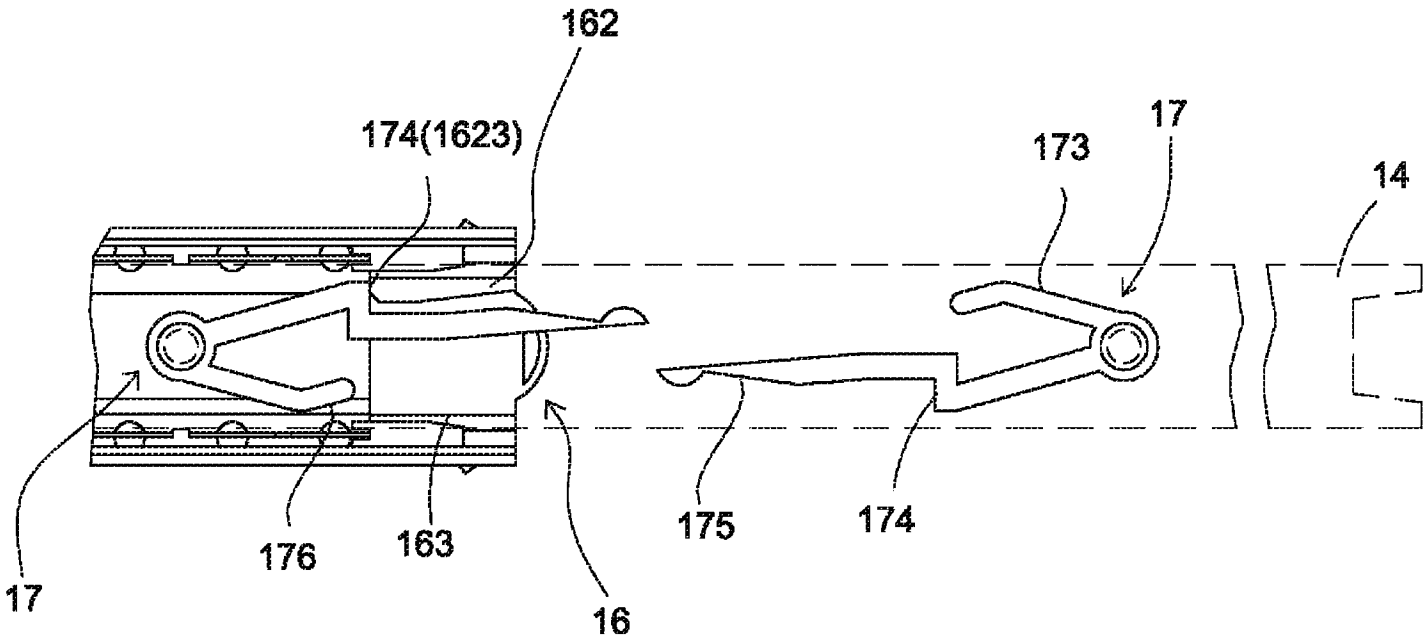
FIG. 8 is a view similar to FIG. 7 showing one limit member being stopped by the stop unit when the drawer is open to its maximum extent.

An opening operation of the drawer 22 from a front end of the cabinet 2 will be described in detail below. As shown in FIGS. 6 to 8, a user may hold the handle 223 to pull the drawer 22 out of the compartment 21. And in turn, the peg 224 disengages from the well 214 and the inner section 14 slides about the intermediate section 12 by riding over the bearing member 15. In a first stage, the intermediate section 12 is concealed in the compartment 21 until an inner end of the inner section 14 is stopped by the stop unit 16. In an intermediate second stage, both the inner section 14 and the intermediate section 12 move rightward as indicated by arrow in FIG. 6. Positions of both the limit members 17 in the second stage are shown in FIG. 7. It is shown that the other limit member 17 (i.e., the limit member 17 to the right) can freely pass the stop unit 16 by riding over the second and first inclined surfaces 1621 and 1622. The second stage movement will ends when the vertical segment 174 of one limit member 17 is stopped by the vertical surface 1623 (see FIG. 8). At this position, the drawer 22 is pulled to its maximum opening extent. A continuous pulling of the drawer 22 will not pull the drawer 22 further away from the compartment 21. A closing operation of the drawer 22 is a mirrored action of the sequence just described.

Figure 9:
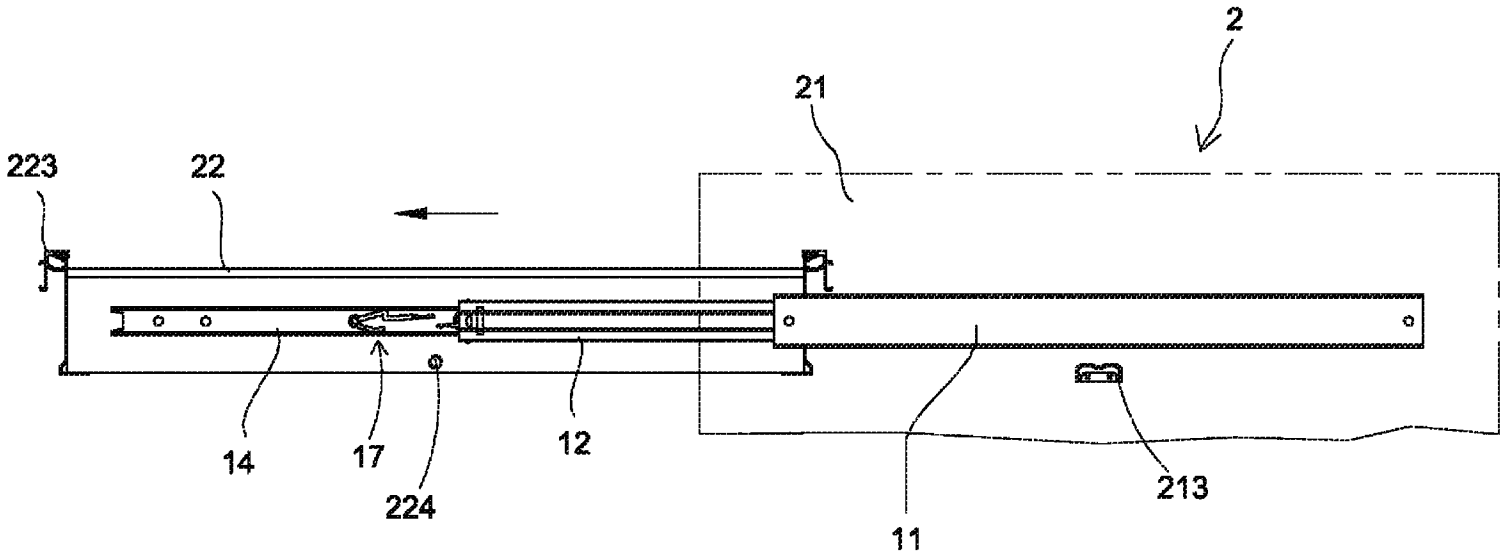
FIG. 9 is a side elevation of the cabinet with the drawer being open to its maximum extent from the rear end of the cabinet.
Figure 10:
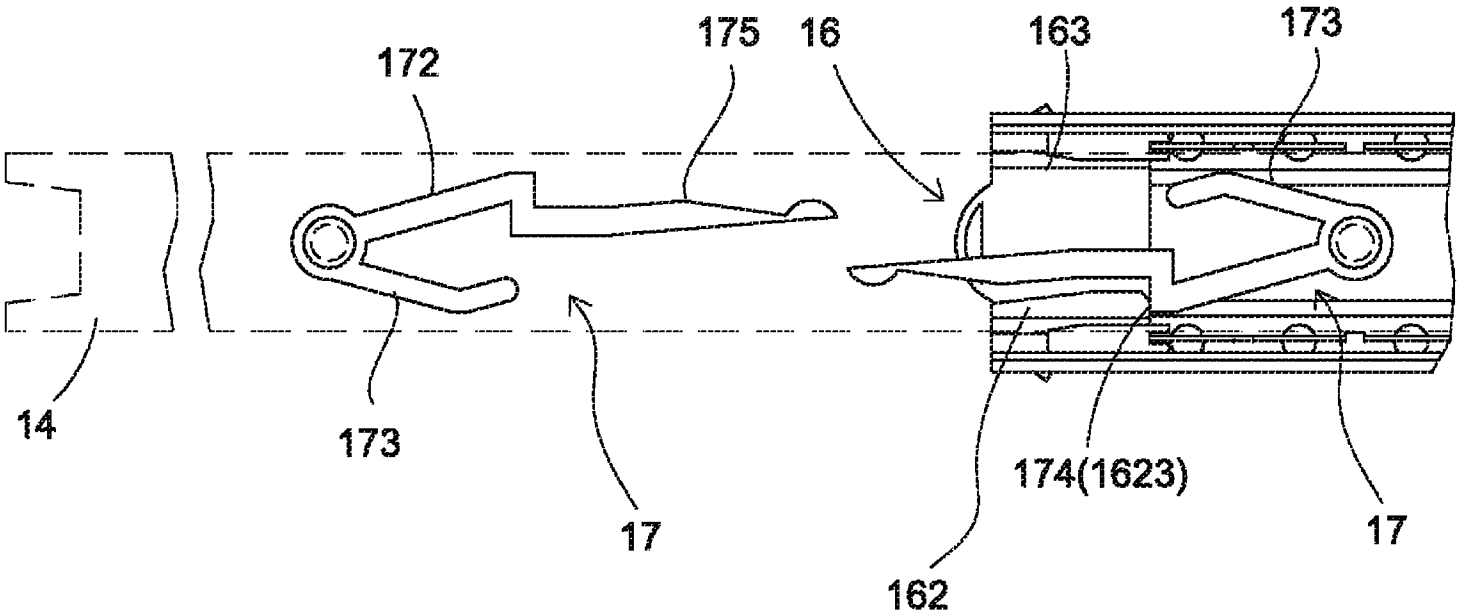
FIG. 10 is a side elevation in part section of FIG. 9 showing the drawer being opened to its maximum extent from the rear end of the cabinet.

An opening operation of the drawer 22 from a rear end of the cabinet 2 will be described in detail below. As shown in FIGS. 9 and 10, a user may hold the handle 223 to pull the drawer 22 out of the compartment 21. And in turn, the peg 224 disengages from the well 214 and the inner section 14 slides about the intermediate section 12 by riding over the bearing member 15. In a first stage, the intermediate section 12 is concealed in the compartment 21 until an outer end of the inner section 14 is stopped by the stop unit 16. In an intermediate second stage, both the inner section 14 and the intermediate section 12 move leftward as indicated by arrow in FIG. 9. One limit member 17 (i.e., the limit member 17 to the left) can freely pass the stop unit 16 by riding over the flange 162. The second stage movement will ends when the vertical segment 174 of the other limit member 17 is stopped by the vertical surface 1623 (see FIG. 10). At this position, the drawer 22 is pulled to its maximum opening extent. A continuous pulling of the drawer 22 will not pull the drawer 22 further away from the compartment 21. A closing operation of the drawer 22 is a mirrored action of the sequence just described.

It is envisaged by the invention that the drawer 22 is free to move in either direction.

While the invention has been described in terms of preferred embodiments, those skilled in the art will recognize that the invention can be practiced with modifications within the spirit and scope of the appended claims.

What is claimed is:

1. A cabinet comprising a compartment including at least one drawer having two sides and configured to be selectively pulled out from opposite ends of the compartment, and at least one set of two opposite slide assemblies, each of the slide assemblies being disposed at either side of each of the at least one drawer and comprising:

an elongated outer section comprising a flat track threadedly secured to the compartment, and two sets of two projecting stop elements wherein the stop elements of either set are opposite and formed on one of two lengthwise curved edges of the track of the outer section;

an elongated intermediate section disposed in the outer section and comprising a flat track, two engaging members at both ends respectively, and two sets of two projecting stop members wherein one set of stop members is proximate to the engaging members at one end, and the other set of stop members is proximate to the engaging members at the other end;

two elongated sliding members each slidably disposed either between upper edges of the outer section and the intermediate section or between lower edges of the outer section and the intermediate section wherein each sliding member is limited to travel in a distance between the stop members of one set and the stop members of the other set;

an elongated inner section threadedly secured to either side of each of the at least one drawer and comprising a two-end open flat track;

an elongated bearing member disposed between the intermediate section and the inner section;

two stop units releasably secured to the engaging members respectively; and two flexible limit members threadedly secured to the inner section wherein one limit member is disposed reverse to the other limit member;

wherein one limit member is allowed to pass one stop unit when each of the at least one drawer is pulled from one end of the compartment, and the other limit member is allowed to pass the other stop unit when each of the at least one drawer is pulled from the other end of the compartment;

wherein the compartment further comprises at least one positioning seat on either side, the positioning seat having a top curved well;

wherein each of the at least one drawer comprises a peg on either side, the peg being rested upon the well when each of the at least one drawer is retracted into a closed position;

wherein the stop unit comprises two bent projections on upper and lower edges respectively; a flange extending from the upper edge but opposite to the adjacent projection, the flange including a vertical surface at one end, a first inclined surface extending from the other end toward one end, and a second inclined surface joining to the vertical surface and the first inclined surface; two horizontal sliding surfaces each extending from one edge of the adjacent projection; a first rib member extending from an upper one of the sliding surfaces and spaced from the flange from above, the first rib member including a cavity at one end; and a second rib member extending from a lower one of the sliding surfaces, the second rib member including a cavity at one end;

wherein the cavity of the first rib member catches either end of an upper edge of the bearing member and the cavity of the second rib member catches either end of a lower edge of the bearing member respectively so as to fasten the bearing member;

wherein the limit member comprises a holed member; two arms extending from the holed member, one arm being at an acute angle with respect to the other arm; a vertical segment extending downward from one arm; an elongated latch extending from the vertical segment; and an inclined segment extending from the other arm; and wherein the vertical segment of one limit member is stopped by the vertical surface of one stop unit when each of the at least one drawer is fully open.

* * * * *